US008562787B2

(12) United States Patent
Frank

(10) Patent No.: US 8,562,787 B2
(45) Date of Patent: Oct. 22, 2013

(54) METHOD FOR PRODUCING PAPER

(75) Inventor: Alexander Frank, Strasshof (AT)

(73) Assignee: Applied Chemicals Handels-GmbH, Vienna (AT)

( * ) Notice: Subject to any disclaimer, the term of this patent is extended or adjusted under 35 U.S.C. 154(b) by 0 days.

(21) Appl. No.: 13/509,373

(22) PCT Filed: Nov. 3, 2010

(86) PCT No.: PCT/AT2010/000417

§ 371 (c)(1),
(2), (4) Date: May 11, 2012

(87) PCT Pub. No.: WO2011/057309

PCT Pub. Date: May 19, 2011

(65) Prior Publication Data

US 2012/0222830 A1 Sep. 6, 2012

(30) Foreign Application Priority Data

Nov. 13, 2009 (AT) ..... A 1800/2009

(51) Int. Cl.
*D21H 11/00* (2006.01)

(52) U.S. Cl.
USPC ..... 162/164.6

(58) Field of Classification Search
USPC ..... 162/164.6, 168.1, 181.6
See application file for complete search history.

(56) References Cited

U.S. PATENT DOCUMENTS

| | | | | |
|---|---|---|---|---|
| 4,913,775 | A | 4/1990 | Langley | |
| 5,584,966 | A | 12/1996 | Moffett | |
| 6,270,627 | B1 * | 8/2001 | Keiser et al. | 162/181.6 |
| 6,395,134 | B1 * | 5/2002 | Chen et al. | 162/168.1 |
| 6,524,439 | B2 * | 2/2003 | Chen et al. | 162/168.1 |
| 8,168,040 | B2 * | 5/2012 | Reinicke | 162/164.6 |
| 2002/0066540 | A1 * | 6/2002 | Chen et al. | 162/17 |
| 2010/0084103 | A1 * | 4/2010 | Reinicke | 162/164.6 |
| 2010/0089541 | A1 * | 4/2010 | Reinicke | 162/164.6 |

FOREIGN PATENT DOCUMENTS

| | | |
|---|---|---|
| DE | 102 36 252 | 5/2003 |
| EP | 0 235 893 | 9/1987 |
| WO | 01/34909 | 5/2001 |
| WO | 2007/031442 | 3/2007 |

* cited by examiner

*Primary Examiner* — Mark Halpern
(74) *Attorney, Agent, or Firm* — Jacobson Holman PLLC

(57) ABSTRACT

In a method for manufacturing paper or the like, in which cationic polymer microparticles comprised of polyacrylamide and a fine-particle inorganic component are added to the paper pulp following the final shearing step and prior to the headbox, whereupon the paper pulp is subjected to dehydration while forming sheets, followed by sheet drying, a polymer mixture comprising a linear cationic polymer and a linear anionic copolymer, whose overall ionicity is anionic, is additionally added immediately prior to the headbox.

13 Claims, No Drawings

METHOD FOR PRODUCING PAPER

This is a national stage of PCT/AT10/000,417 filed Nov. 3, 2010 and published in German, which claims the priority of Austria number A 1800/2009 filed Nov. 13, 2009, hereby incorporated by reference.

The present invention relates to a method for manufacturing paper or the like, in which cationic polymers comprised of polyacrylamide and a fine-particle inorganic component are added to the paper pulp following the final shearing step and prior to the headbox, whereupon the paper pulp is subjected to dehydration while forming sheets, followed by sheet drying.

In papermaking, machines which are able to produce up to 200 tons of paper per day are nowadays available, the point of such machines being to hold back on the screen as much as possible of the suspended fibers, fines and fillers so as to return backwater as unpolluted as possible. This holding-back of fibers, fines and fillers is referred to as retention, a maximum retention naturally being only achievable by the optimal activity of the retention agent.

Among the presently used retention agent systems, systems comprising an inorganic component and a cationically modified synthetic polymer are of particular importance, wherein microparticle systems comprising a cationic polymer and a fine-particle inorganic component are, in particular, added to the paper pulp after the final shearing stage and prior to the headbox in order to maximize retention, as can, for instance, be taken from DE 102 36 252 A1. In that case, polymers such as polyacrylamide, polyamidoamine, polyethylene amine and the like are used as cationic polymers.

Furthermore, attempts have been made in the paper industry to improve the retention of paper by the addition of so-called flocculation agents in that, prior to the final shearing step, cationic polymers are added, which, in combination with the shearing stress in the final shearing step, e.g. the centrifugal strainer, cause large flocks to precipitate from the paper pulp, which are to be partially reflocculated again by the addition of, for instance, inorganic substances and anionic branched polymers in order to dehydrate the paper pulp as rapidly as possible so as to improve sheet formation.

A system of this type can, for instance, be taken from EP-B 1 242 685, in which a cellulose suspension is flocculated by the addition of a cationic polymer and by shear stress, whereupon a siliceous material and an anionic branched polymer comprised of an ethylenically unsaturated anionic monomer or monomer mixture and a branching agent are added after the shear stress in order to improve retention, dehydration and formation.

The present invention now aims to provide a retention system based on known retention systems and flocculation systems, which, on the one hand, shows an even further improved retention as compared to conventional systems and, on the other hand, in addition to enabling remarkable savings of the amount of retention aids to be added, also extremely accelerates the dehydration during sheet formation relative to conventional methods in order to make paper whose sheet surface is as uniform as possible.

To solve this object, the method according to the invention is characterized in that a polymer mixture comprising a linear cationic polymer and a linear anionic copolymer, whose overall ionicity is anionic, is additionally added immediately prior to the headbox. By additionally adding a polymer mixture comprising a linear cationic polymer and a linear anionic copolymer, whose overall ionicity is anionic, immediately prior to the headbox, it is possible to ensure that the paper pulp, unlike with the addition of known anionic systems, will not be reflocculated but, in the main, only form extremely small flocks on account of the missing shear stress and the short time available, whereby, in a surprising manner, not only the retention but also the formation of the paper will be remarkably improved relative to known methods. By adding the polymer mixture immediately prior to the headbox, i.e. at the latest possible moment, and by ensuring that no cross-linked portions are contained in the polymer mixture, further optimization of the retention of fillers in the context of the overall system and, furthermore, in particular, a remarkably reduced load on the waste water due to the 30% reduction of the amount added of the substances constituting the retention system will be enabled.

According to a further development of the invention, the method is conducted in a manner that polydiallyl dimethyl ammonium chloride with a cationic charge of about 6 mol per kg dry product is used as said linear cationic polymer in the polymer mixture. Polydiallyl dimethyl ammonium chloride having a cationic charge of about 6 mol per kg dry product by itself is used as a cationic retention agent in papermaking, wherein it has, however, turned out that, if polydiallyl dimethyl ammonium chloride is added after the final shearing step and immediately prior to the headbox in combination with a linear anionic copolymer, it will not only be possible to achieve further improvement of the retention, but it will, in particular, be ensured that no appreciable flocculation will occur and, in particular, no more flocks having dimensions affecting the formation during sheet-making will be formed, so that the overall retention will be further improved and, in particular, the quality of the waste water from papermaking will be further enhanced in terms of freedom of suspended matter.

Particularly good results will be achieved if, as in correspondence with a preferred further development of the present invention, the linear cationic polymer is used at a particle size, in the non-swollen state, of less than 2 μm. If a cationic, linear polymer having a particle size of less than 2 μm is used, the particles of the linear cationic polymer will be of the same size as the particles of the fillers in the paper pulp, particularly in the swollen state, such that a particularly uniform surface of the paper sheet will be achieved after dehydration and formation at a simultaneously improved retention.

Further enhancement of the effectiveness of the retention system can be achieved in that a copolymer of acrylamide and sodium acrylate at a molar ratio of acrylamide to sodium acrylate of 50:50 to 70:30 and an anionic charge of about 4 mol per kg dry product is used as said linear anionic copolymer. By using such a linear copolymer, it is feasible to use an anionic linear copolymer which, particularly in combination with the cationic polymer, will further improve the retention in the polymer mixture while largely preventing reflocculation. By using a linear anionic copolymer having a particle size, in the non-swollen state, of between 30 and 250 μm, it is also feasible to provide the linear anionic copolymer in the same size as the filler particles in the paper pulp, whereby, besides an improved retention simultaneously achievable by using smaller amounts of retention agent, also a completely smooth and failure-free paper surface after drying of the sheet will be provided.

By conducting the method in a manner that the proportion of the linear cationic polymer to the linear anionic copolymer in the polymer mixture ranges between 2:8 and 0.5:9.5, as in correspondence with a preferred further development of the present invention, it will, in particular, be ensured that no reflocculation of the paper pulp will occur, and the formation will thus not be affected.

By selecting the proportion of the cationic polymer to the linear anionic copolymer in the polymer mixture, about 20% product savings of the retention aids to be added in total will, in particular, be achieved relative to prior art methods, and it will, moreover, be safeguarded that a pure filler flocculation will be prevented so as to not only improve the formation of the finished product, such as opacity and two-sideness, but also ensure massive savings, particularly material savings, throughout the manufacturing process.

By conducting the method according to the present invention in a manner that the polymer mixture is used as a suspension in oil and, in particular, in a mixture of isoparaffin oil, technical white oil, sorbitan monooleate as well as, optionally, additives like stabilizers such as, e.g., a hydrophobically modified acrylic copolymer, a polymer-activating, surface-active material such as, e.g., a synthetic condensate of a primary alcohol and ethylene oxide as well as further additives selected from 2,2'-azobis(2-methylbutyronitrile), urea, or a sodium salt of diethylenetriamine pentacetic acid, the surface tension will, on the one hand, be reduced by using a suspension or dispersion in oil, whereby the use of defoamers in the papermaking cycle can be avoided. In that further additives such as a stabilizer, a hydrophobically modifying acrylic copolymer, a polymer-activating, surface-active material are optionally used, the reaction speed of the polymer mixture will, in particular, be increased, which will in turn result in an improved overall fiber retention and, on the other hand, ensure that the employed polymer mixture will not be decomposed, have an active surface and, in particular, safely prevent any further, undesired polymerization, thus achieving a further reduction of the material amounts to be used at a simultaneously enhanced retention.

In that, as in correspondence with a further development of the invention, all of the polymers contained in the polymer mixture are water-soluble, it is feasible, as against the use of commercially available anionic polymers employed, for instance, as reflocculation agents, to remarkably reduce the amount of employed polymer mixture, on the one hand, and to lower the reaction time of the polymer mixture in the paper pulp, on the other hand, thus safely preventing a pure filler flocculation while additionally further improving retention.

According to a preferred further development, the method is conducted in a manner that the polyacrylamide to be added following the final shearing step is used as a dispersion or emulsion in oil. By using the polyacrylamide to be added after the final shearing step as a dispersion or emulsion in oil, the surface tension of the paper pulp is even further reduced and, as a result, the use of defoamers in the paper machine cycle can be completely avoided or extremely strongly reduced, i.e. by up to 70%. By adding the polyacrylamide at the latest moment possible after the final shearing step, product savings are, moreover, increased by about 20% due to the time missing to form flocks as compared to the use of cationic polymers prior to the final shearing step, which additive is intended and aimed to cause a flocculation of the system, which is to be avoided according to the invention. In that the cationic polymer is added after the final shearing step, a polymer having a lower molecular weight can, furthermore, be selected, thus again reducing the flock sizes or prevent the formation of flocks altogether.

According to a preferred further development of the method, the latter is conducted in a manner that an alkali-activated bentonite having a silicon dioxide content of less than 2% by weight, in particular an alkali-activated bentonite essentially completely consisting of montmorrillonite, is used as said fine-particle inorganic component. By using an alkali-activated bentonite having a silicon dioxide content of less than 2% by weight or, in particular, an alkali-activated bentonite essentially completely consisting of montmorrillonite, defects of the sheet surface by the hard silicon dioxide crystals will be prevented for sure. A higher content of silicon dioxide would, moreover, cause abrasion or wear of the machine parts such that the use of the bentonite grade according to the invention, particularly in fast-running high-capacity paper machines, will remarkably improve the lifetimes of such high-capacity machines.

In that a bentonite having an internal surface area of at least 400 $m^2/g$, particularly 600 to 850 $m^2/g$, and a mean particle size of less than 2 μm is used as said alkali-activated bentonite, as in correspondence with a further development of the invention, the absorption of foreign matter will be encouraged by the large internal surface area of the bentonite and, in particular, montmorrillonite, and hence the purity of the water cycle, particularly the quality of the wastewater, will be further raised and remarkably improved.

In order to ensure as rapid a formation of hydrogen bridges as possible with the fibers of the paper pulp, the method according to the invention is further developed to the effect that a bentonite having a negative surface charge and a positive edge charge is used as said alkali-activated bentonite. The particularly rapid formation of hydrogen bridges with the fibers of the paper pulp ensures a particularly rapid separation of water and solids, thus extremely accelerating the dehydration of the sheet formation relative to conventional methods.

Further improvement of the effectiveness of the alkali-activated bentonite will be achieved in that the bentonite is used with a pH in the suspension of at least 7.8, in particular at least 8, thus particularly improving the formation and contributing to an accelerated dehydration.

In order to further reduce the formation of flocks and, in particular, the flock size and, in addition, further accelerate the process, the method according to the invention is conducted in a manner that the cationic polyacrylamide is at first added to the paper pulp after the final shearing step, and the bentonite and, at the same time, the polymer mixture, are added immediately prior to the headbox. By simultaneously adding the bentonite and the polymer mixture to the paper pulp immediately prior to the headbox, a further reduction of flock formation will be achieved so as to enable an altogether improved retention at a simultaneous reduction of the material input by up to 30%. Besides improving the retention, the dehydration will be accelerated, and the formation will be improved, due to the reduced flock size and the avoided reflocculation.

In the following, the invention will be explained in more detail by way of a comparative example.

COMPARATIVE EXAMPLE

Four variants of the addition of retention aids and/or reflocculation agents were compared with one another in respect to the times of addition and the employed materials. All tests were performed on a test machine comprising two parallel vertical sorters each comprising an energy input of 1,100 kWh. The length of the piping of the test machine as far as to the headbox was 12 m and 15 m, respectively, and the flow rate of the main flow was 1,850 l/s, so that the time from the vertical sorter to the head box was 5 seconds each.

In all tests, the temperature of the stock flow was 40° C. to 55° C.

Test Set-Up 1

The addition of a cationic polymer in an amount of 150 g/t to the stock flow prior to the vertical sorter and the addition of 2.5 kg bentonite/t immediately prior to the headbox resulted in an overall retention of 58%, an ash retention of 20%, an ash content in the finished paper of 15. Such a test array was limited by poor formation and showed poor dehydration efficiency.

Test Set-Up 2

The addition of a cationic polymer at a dosage of 280 g/t prior to the vertical sorter, a flocculation of the stock flow, the addition of a partially cross-linked anionic polymer in an amount of 80 g/t following the vertical sorter, and the addition of bentonite in an amount of 2 kg/t immediately prior to the headbox resulted in an overall retention of 65%, an ash retention of 37%, an ash content in the finished paper of 18%, and a dehydration efficiency which was improved relative to that of test-setup 1.

Test Set-Up 3

The addition of a cationic polymer in an amount of 350 g/t following the vertical sorter, the addition of 2.5 kg bentonite immediately prior to the headbox resulted in an overall retention of 60%, an ash retention of 31%, an ash content in the finished paper of 18 as well as a slightly improved formation and a slightly improved dehydration efficiency relative to those of test set-up 1.

Test Set-Up According to the Present Invention

The addition of a cationic polymer, namely acrylamide, in an amount of 150 g/t after the vertical sorter, the addition of a polymer mixture comprising a linear anionic polymer and a cationic polydiallyl dimethyl ammonium chloride in an amount of 100 g/t as well as the addition of 1.8 kg/t bentonite directly prior to the headbox resulted in an overall retention of 65%, an ash retention of 41%, an ash content in the finished paper of 18, and a formation and dehydration of the paper which were remarkably improved over those of the preceding tests. Compared to the test sep-up 2, which yielded the best results after the test set-up according to the present invention, material savings of about 20% could be obtained in addition to the achievement of an improved result, both with the cationic and with the anionic polymer.

Material savings of the employed polymers of about 20% with, at the same time, remarkably improved results are also feasible relative to test set-up 3.

The invention claimed is:

1. A method for manufacturing paper, in which cationic polymers comprised of polyacrylamide and a fine-particle inorganic component are added to paper pulp following a final shearing step and prior to a headbox, whereupon the paper pulp is subjected to dehydration while forming sheets, followed by sheet drying, characterized in that an alkali-activated bentonite having a silicon dioxide content of less than 2% by weight, in particular an alkali-activated bentonite essentially completely consisting of montmorrillonite, is used as said fine-particle inorganic component and that a polymer mixture comprising a linear cationic polymer, namely a polydiallyl dimethyl ammonium chloride having a cationic charge of about 6 mol per kg dry product and a linear anionic copolymer, whose overall ionicity is anionic, namely a copolymer of acrylamide and sodium acrylate at a molar ratio of acrylamide to sodium acrylate of 50:50 to 70:30 and an anionic charge of about 4 mol per kg dry product, is additionally added immediately prior to the headbox.

2. The method according to claim 1, characterized in that the linear cationic polymer is used at a particle size, in the non-swollen state, of less than 2 μm.

3. The method according to claim 1, characterized in that a linear anionic copolymer having a particle size, in the non-swollen state, of between 30 and 250 μm is used.

4. The method according to claim 1, characterized in that the proportion of the linear cationic polymer to the linear anionic copolymer in the polymer mixture ranges between 2:8 and 0.5:9.5.

5. The method according to claim 1, characterized in that the polymer mixture is used as a suspension in oil and, in particular, in a mixture of isoparaffin oil, technical white oil, sorbitan monooleate as well as, a stabilizer selected from the group consisting of a hydrophobically modified acrylic copolymer, and a polymer-activating, a surface-active material selected from the group consisting of a synthetic condensate of a primary alcohol and ethylene oxide as well as further additives selected from 2,2'-azobis(2-methylbutyronitrile), urea, or a sodium salt of diethylenetriamine pentacetic acid.

6. The method according to claim 1, characterized in that the polymers contained in the polymer mixture are water-soluble.

7. The method according to claim 1, characterized in that the polyacrylamide to be added following the final shearing step is used as a dispersion or emulsion in oil.

8. The method according to claim 7, characterized in that the alkali-activated bentonite is used with a pH in the suspension of at least 7.8.

9. The method according to claim 8, wherein the alkali-activated bentonite is used with a pH in the suspension of at least 8.

10. The method according to claim 1, characterized in that bentonite having an internal surface area of at least 400 $m^2/g$, and a mean particle size of less than 2 μm is used as said alkali-activated bentonite.

11. The method according to claim 10, wherein bentonite having an internal surface area of 600 to 850 $m^2/g$.

12. The method according to claim 1, characterized in that a bentonite having a negative surface charge and a positive edge charge is used as said alkali-activated bentonite.

13. A The method according to claim 1, characterized in that the polyacrylamide is at first added to the paper pulp, and the bentonite and, at the same time, the polymer mixture are added immediately prior to the headbox.

* * * * *